United States Patent [19]

Allwin et al.

[11] Patent Number: 4,681,159

[45] Date of Patent: Jul. 21, 1987

[54] SETTING TOOL FOR A WELL TOOL

[75] Inventors: Roger P. Allwin; Mark Budke, both of Bryan, Tex.

[73] Assignee: MWL Tool Company, Midland, Tex.

[21] Appl. No.: 810,100

[22] Filed: Dec. 18, 1985

[51] Int. Cl.[4] ..... E21B 23/00

[52] U.S. Cl. ..... 166/124; 166/181

[58] Field of Search ..... 166/123–125, 166/181–182, 212, 217; 285/140–143

[56] References Cited

U.S. PATENT DOCUMENTS

| | | | |
|---|---|---|---|
| 3,136,367 | 6/1964 | Wright et al. | 166/124 |
| 3,207,222 | 9/1965 | Tamplen | 166/237 |
| 4,060,131 | 11/1977 | Kenneday et al. | 166/125 |
| 4,175,778 | 11/1979 | Nunez et al. | 166/125 |
| 4,399,873 | 8/1983 | Lindsey, Jr. | 166/212 |
| 4,440,233 | 4/1984 | Baugh et al. | 166/124 |
| 4,441,560 | 4/1984 | Baugh et al. | 166/124 |
| 4,497,371 | 2/1985 | Lindsey, Jr. | 166/212 |

*Primary Examiner*—Stephen J. Novosad
*Assistant Examiner*—Bruce M. Kisliuk

[57] ABSTRACT

In a PBR system in well bores, a retrievable landing assembly which can be set either mechanically or hydraulically has a telescopic setting sleeve and setting collar where the setting collar is interconnected to a setting tool by a first threaded nut member and a second threaded nut member. The setting tool is threadedly attached by one of the threaded nut members to the setting collar and the one threaded nut member is splined for longitudinal movement with respect to a mandrel of the setting tool while the other nut member is longitudinally and releasably splined to the setting collar and threadedly attached to the mandrel of the setting tool. The setting tool has a shiftable sleeve member which can be shifted by a pressure ball and applied pressure to shift the setting sleeve of the landing assembly into a locking position in the setting collar. Alternatively, one of the nut members can be operated to release the mandrel of the setting tool relative to the setting collar of the land assembly so that weight can be applied through the tubing string to the mandrel and the shiftable sleeve member to the setting sleeve of the landing assembly.

9 Claims, 6 Drawing Figures

SETTING TOOL FOR A WELL TOOL

FIELD OF THE INVENTION

This invention relates to oilwell production tools, and more particularly, to a retrievable landing assembly for use in a packer bore receptacle system which can be set in a packer bore receptacle either hydraulically or mechanically.

DESCRIPTION OF THE PRIOR ART

Packer bore receptacle systems or "PBR" Systems are typically employed on top of a production liner in conjunction with a liner hanger disposed in a well bore. A PBR typically has a long polished bore which slidably and sealingly receives a sealing assembly on the end of a tubing string or string of tubing. Thus, a tubing end is slidably and sealingly free to move in the polished bore in response to expansion or contraction of the tubing string without affecting the sealing relationship between the tubing string and the PBR.

A retrievable landing assembly is intended for use within a PBR and when installed; permits use of a smaller diameter tubing string or closure plugs for remedial work. The retrievable landing assembly typically is received within a PBR and uses a multiple latching lug system to releasably latch the retrievable landing assembly in a precut latching groove in the PBR.

In the prior art a latching lug system of a retrievable landing assembly can be mechanically set by first landing the landing assembly by engagement of the landing assembly with a no-go internal landing shoulder in the PBR. The setting of the latching lug system is accomplished by setting down weight through the tubing string to the landing assembly to force a setting sleeve to shear a shear pin and release to set the latching lug system in the precut latching groove in a PBR. The energy for setting the latching lug system in the latching groove comes from a compressed spring in the tool which drives the setting sleeve. A system of this type is illustrated in 1980, 1981 composite catalogue of oilfield equipment, 34th revision on page 6883.

Retrievable landing devices have also been hydraulically set in a PBR as illustrated in U.S. Pat. No. 4,497,371 or U.S. Pat. No. 4,399,873. In a hydraulically set landing assembly; a ball is dropped through the tubing string to close off the bore of a setting sleeve in the landing assembly or in a setting tool and then applied hydraulic pressure in the tubing string shifts a setting sleeve in the landing assembly or setting tool to set or actuate the latching lug system in the landing assembly into engagement with the latching groove of the PBR.

In some instances, a hydraulically actuated system in a retrievable landing assembly can plug up or fail to operate properly in a well bore. When the landing assembly fails to operate, another trip of the landing assembly is required to get another landing assembly in the well bore. Thus, it is desirable to provide an alternative positive setting operation of a landing assembly in a PBR in a well bore; either mechanically or hydraulically.

Accordingly it is object present invention to provide a system for setting a landing assembly which includes a retrievable insert landing assembly in a PBR which can be operated selectively either hydraulically or mechanically.

DESCRIPTION OF THE INVENTION

The present invention includes a retrievable landing tool or assembly for a PBR which is insertable together with a retrievable setting tool through a string of pipe or tubing in a well bore and which seats on a landing shoulder in the bore of a polished bore receptacle (PBR). When seated on the landing shoulder, a pressure sealing ball is dropped through the tubing string to seat in the bore of an actuator sleeve in the setting tool to provide a hydraulic actuator. Hydraulic pressure is applied through the tubing string and the effect of the hydraulic pressure produces a force in the hydraulic actuator which shifts to break a shear pin. When the shear pin is severed, the tubular actuator sleeve shifts a tubular setting sleeve to project movable latching lugs in a setting collar into locking engagement with a latching groove in the production bore receptacle. The setting collar and setting sleeve are telescopically and releasably locked relatively to one another while the latching lug elements are in an extended position in the latching groove.

The setting tool is released by right hand rotation so that an interconnecting traveling nut on the setting tool disconnects from an internal thread in the setting collar and the tubing string and setting tool then can moved upwardly relative to the PBR and can be retrieved without affecting the PBR or the latched landing assembly.

If it is desired to retrieve the landing assembly from the PBR, a tubing string is run in the well bore with a spear which can be coupled to the setting sleeve to exert an upward pull on the setting sleeve. When the spear engages the setting sleeve and is pulled upwardly, shear releasable locking means between the setting collar body and setting sleeve are released. Once the locking means are released, the lugs are retracted and the landing assembly can be retrieved.

As an alternative to hydraulic setting of the setting sleeve, the setting tool has a mechanical setting system. The mechanical setting system is incorporated in a second releasable nut which is threadedly attached to the tubing string and has a longitudinally extending spline coupling to the setting collar. To set the setting sleeve mechanically, rotation of the tubing string releases the tubing string relative to the setting collar so that the tubing string can be moved downwardly to apply weight to the setting sleeve and shift the setting sleeve relative to the setting collar.

DESCRIPTION OF THE PREFERRED EMBODIMENT

Figure 1:
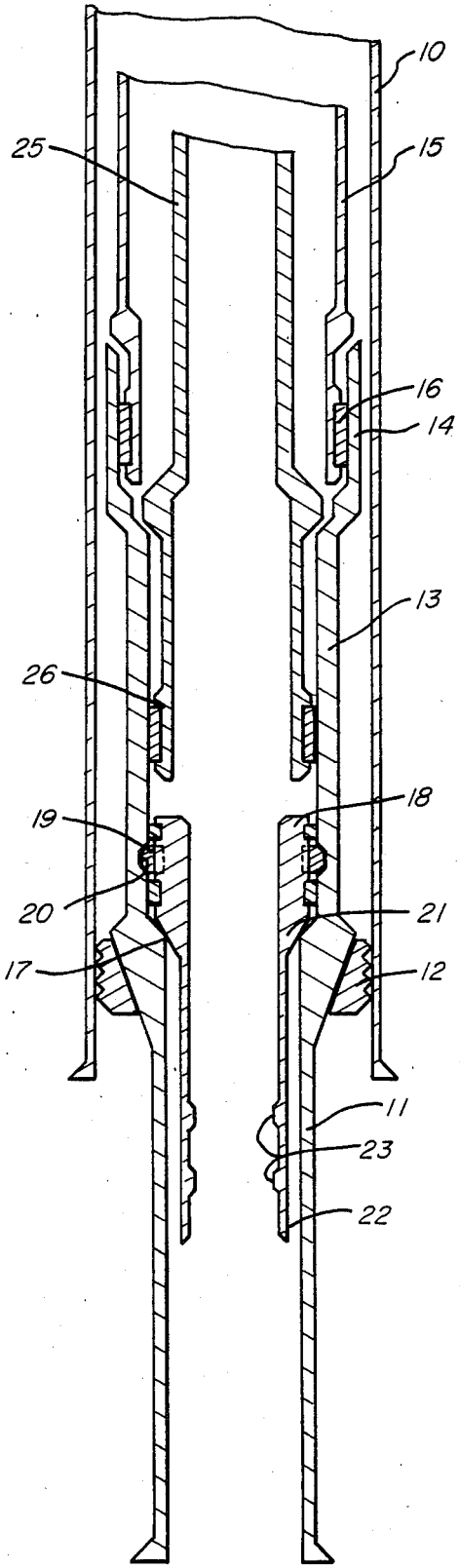
FIG. 1 schematically illustrates a well bore and liner hanger for background purposes.
Figure 3:
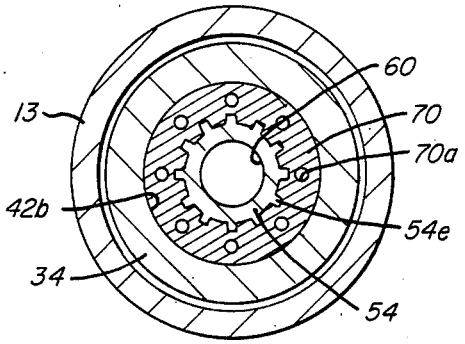
FIG. 3 is a view in cross-section taken along line 3—3 of FIG. 2A.
Figure 4:
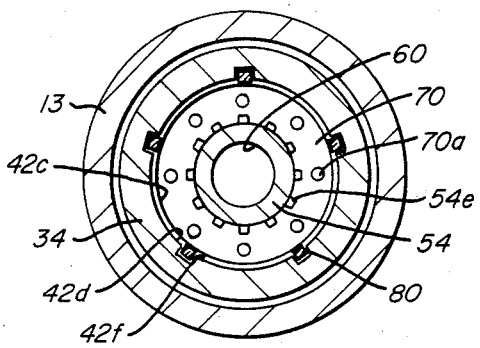
FIG. 4 is a view in cross-section taken along line 4—4 of FIG. 2A.
Figure 5:
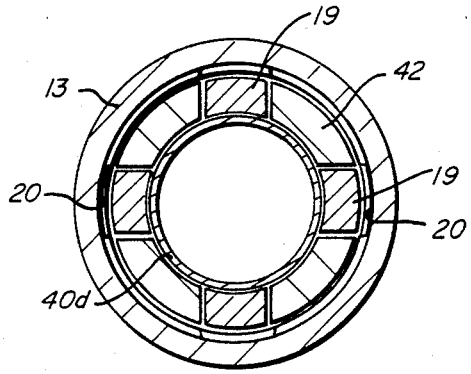
FIG. 5 is a view in cross-section taken along line 5—5 of FIG. 2B.

Referring now to FIG. 1, a well bore is illustrated to show use of the present invention. A surface string of casing 10 is shown in a cemented position in a well bore. At the lower end of the casing 10, a liner 11 overlaps the lower end of the casing 10 and extends downwardly from the end of casing 10 through a smaller diameter borehole and is in position for cementing. The liner 11 at its upper end is attached to a liner hanger which has a slip assembly 12, a packer bore receptacle 13 and a tie back sleeve 14. A setting tool (not shown) on a tubing string is utilized to set the liner slips of the slip assembly 12 in the casing 10. Thereafter, the liner 11 can be cemented in place in the borehole and the setting tool removed.

The tie back sleeve 14 has a polished bore which cooperates with an outer seal assembly 16 on a casing string 15. The seal assembly 16 is slidably and sealingly received in the tie back sleeve 14 where the bore of the casing string 15 is larger than the bore of the PBR 13. The PBR 13 has an a upwardly facing landing shoulder 17 and a retrievable landing assembly 18 is adapted to seat on the shoulder 17 and is provided with latching lugs 19 which are received in an annular latching groove 20 in the PBR 13. Annular seals are provided above and below the latching lugs 19 to seal off the landing assembly 18 with respect to the bore of the PBR 13.

The retrievable landing assembly 18 normally has a tail pipe or tubular member 22 with landing profiles or internal shoulders 23 for receiving plugs or the like. The retrievable landing assembly 18 is set in the PBR 13 by a setting tool (not shown) which actuates the latching lugs 19 into locking engagement with the locking groove in the PBR.

After the retrievable landing assembly 18 is positioned in place, a tubing string 25 with a sealing assembly 26 can be provided where the sealing assembly 26 is slidably and sealingly received in a polished bore of the PBR 13 and the tubing string 25 is in communication with earth's surface. Thus, the retrievable landing assembly permits the bore of the tail pipe 22 to receive sealing plugs so that the tubing string 25 can be pulled or replaced while not affecting the well bore below the landing assembly 18.

Figure 2A:
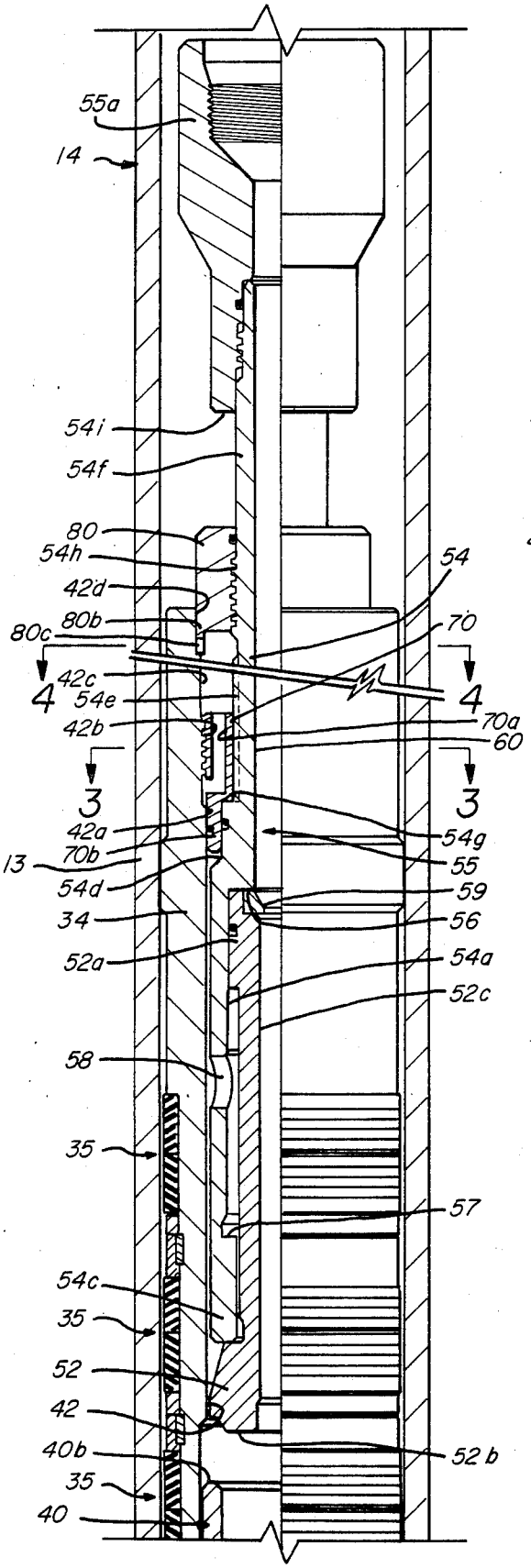
FIGS. 2A and 2B are in partial longitudinal cross-section to illustrate the features of the present invention.
Figure 2B:
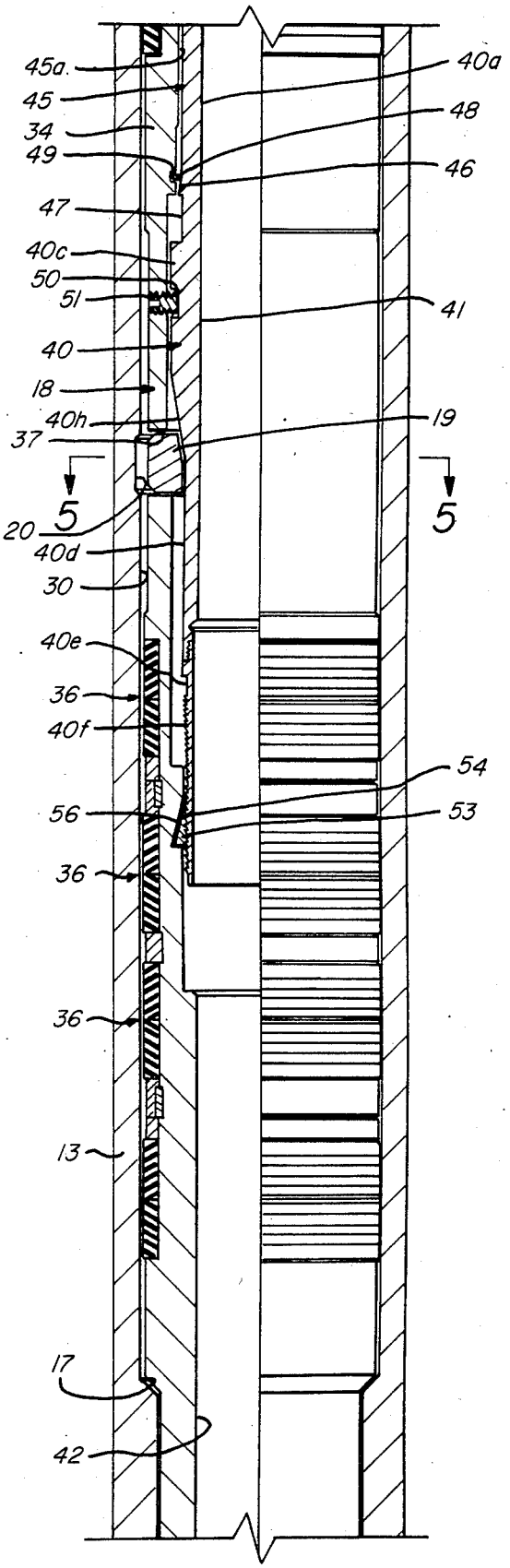

Referring now to FIGS. 2A and 2B, a tie back sleeve 14 and PBR 13 are partially illustrated wherein the PBR 13 has a landing shoulder 17 (FIG. 2B) formed between stepped diametrical portions of the bore in the PBR 13. Above the landing shoulder 17 is annular latching groove 20 cut into the bore 30 of the PBR 13. The annular latching groove 20 is adapted to receive latching lugs 19 which are incorporated into the retrievable landing assembly 18.

The retrievably landing assembly 18 includes a tubular setting collar 34 having upper and lower external and annular seal members 35 and 36 located above and below a slotted window 37, where the latching lugs 19 are located in the slotted window 37. At least three (3) latching lugs 19 are circumferentially disposed about the circumference of the setting collar 34 at an equal, angular relationship.

Telescopically received within the bore of the setting collar 34 is a tubular setting sleeve 40 which has a uniformly sized internal bore 41 (FIG. 2B). The bore 41 of the setting sleeve 40 is similar in diameter to an upper and lower bore portion 42 in the setting collar. The setting sleeve 40 is telescopically received in an enlarged bore section 45 of the setting collar 34 which is located intermediate of the upper and lower bore portions 42.

The setting sleeve 40 is shown in upper first position where the latching lugs 19 are retracted. The setting sleeve 40 is movable to a lower second position where the latching lugs 19 are extended into the annular latching groove 20 in the PBR and is movable to an upper third position where the latching lugs 19 are retracted and the sleeve 40 is locked to the setting collar 40 against substantial longitudinal movement.

The enlarged intermediate bore section 45 has a first bore section **45*a* which receives an upper tubular portion 40*a* of the setting sleeve 40. The cross-sectional area of the tubular portion 40*a* is sized to extend into and overlap the bore 42 so that an actuator sleeve 52 on a setting tool 55 can engage the facing upper end surface 40*b* of the tubular portion 40*a*. The tubular portion 40*a* has an outer inclined ramp surface 46 and recess 47 at its lower end. In the upper first position of the setting sleeve 40, the ramp 46 and recess 47 are disposed below an annular resilient snap ring 48 disposed in an annular groove 49 in the setting collar 34. When the setting sleeve 40 is moved to the third upper position, the snap ring 48 moves over the ramp 46 and into the recess 47 where engagement of the snap ring with a recess shoulder prevents downward movement of the setting sleeve 40 relative to the setting collar 34**.

Below the recess 47 the setting sleeve 40 has an enlarged diametrical portion **40*c* which has an annular groove 50 adapted to receive a shear pin 51 to releasably maintain the setting sleeve 40 in the first upper position relative to the setting collar 34 until sufficient relative force is applied to shear the end of the shear pin 51 in the groove 50. Below the diametrical portion 40*c* is an conically shaped surface 40*h* which is inclined downwardly and inwardly to define an expander surface. At the lower end of the expander surface 40*h* is a reduced diameter portion 40*d*. In the first upper position of the setting sleeve 40, the latching lugs 19 are disposed adjacent to the diameter portion 40*d*. The latching lugs 19 are generally rectangularly shaped and respectively sized to slide radially between the end and side walls of a window or slot 37. The facing surface of a lug to the expander surface 40*h* can have a complementary inclination. While not shown, annular resilient retaining means can be received in an outer groove on the lugs to resiliently retain the lugs in a retracted position. When the setting sleeve 40 is moved from a first upper position to a second lower position, the expander surface 40*h* moves the latching lugs 19 outwardly into latching engagement with the latching groove 20**.

Below the sleeve diameter portion **40*d* is a breakable thin wall section 40*e* constructed of brass which is adapted to part or sever upon application of a predetermined pulling force on the setting sleeve 40**.

Below the breakable portion **40*e* is an outer serrated locking section 40*f* and at the lower end of the locking section 40*f* is an annular locking ring 53 having internal serrated teeth 54 and an outer conically shaped inclined surface 56 which is upwardly and inwardly inclined. The locking ring 53 is located within an annular recess in the setting collar 34 which has a complementary inclined surface. The locking ring 53 is split and of resilient material so that upon downward relative movement of the setting sleeve 40 relative to the setting collar 34, the ring 53 ratchets relative to the serrations on the locking section 40*f* and permits the relative movement. The ring 53 is a one-way locking mechanism in that the interengagement of the ring 53 with the serrations on the locking section 40*f* and the interengagement of the inclined surface 56 with the inclined surface in the setting collar 34 prevents upward movement of the locking section 40***f* relative to the setting collar. Thus, when the setting sleeve 40 is moved from the first position to the second position, the latching lugs 19 are brought in locking relationship to the latching groove 20 and the setting sleeve 40 is locked in the second position by the one way locking mechanism.

The setting sleeve 40 subsequently can be released from the second position by connecting a spear on a tubing string and exerting an upward pull which is sufficient to part the breakable portion 40*e*. When the portion 40*e* severs or breaks, the upper part of the setting sleeve 40 above the portion 40*e* moves upwardly and releases and retracts the latching lugs 19 from the latching groove 20 and ultimately the snap ring 48 locks the recess 47 of setting sleeve 40 in a upper third position.

Referring now to FIG. 2A, at the upper end of the setting collar 34, the upper bore portion 42 has (in ascending order of dimensions) a first enlarged diameter portion 42*a*, a second enlarged and internally threaded portion 42*b*, a third enlarged bore portion 42*c* and a fourth terminal locking portion 42*d*.

The setting tool 55 includes a tubular setting tool mandrel 54 which is adapted for coupling at its upper end 55*a* to a string of tubing and has a telescopically arranged tubular actuator sleeve 52 at its lower end. The setting tool mandrel 54 is adapted to be received within the bore 42 of the setting collar 43.

The actuator sleeve 52 has an outer upper flange portion 52*a* which is slidably and sealingly received in an enlarged internal recessed bore portion 54*a* of the mandrel 54. Thus, the flange portion 52*a* is slidably and sealingly received within the longitudinal confines of the recessed bore portion 54*a* of the mandrel 54 for movement between the upper position shown and a lower position where the end 52*b* of the sleeve 52 engages and moves the setting sleeve 40 from a first upper position to a second lower position. The recess 54*a* is defined between upper and lower shoulders 56 and 57 and a bypass port 58 is provided in the wall of the mandrel 54 for a fluid bypass upon retrieval. The lower end 52*b* of the actuator sleeve is engagable with the upper end 40*b* of the sleeve 40.

The bore 52*c* of the actuator sleeve 52 at its upper end is provided with an inwardly extending flange 59 relative to the bore 60 of the mandrel 54 to form a pressure ball seat. Thus, a pressure ball when dropped through a tubing string can be sealingly seated on the flange 59 so that application of fluid pressure in the tubing string will shift the actuator sleeve 52 from a first upper position to a second lower position. In the upper position of the actuator sleeve, the flange 52*a* engages the downwardly facing surface 56.

The setting tool mandrel 54 at its lower end has an internal flange 54*c* which is slidably in an outer recess of the actuator sleeve 52 where the recess is between the flange 52*a* and the end 52*b* of the sleeve 52. The outer surface of the mandrel 54 which is located above the internal recess shoulder 56 is reduced in diameter successively at portions 54*d*, 54*e* and 54*f*. An annular traveling nut 70 is disposed in the annular space between the setting tool mandrel 54 and the setting collar 34. The traveling nut 70 has a pressure relief bore 70*a* and a lower annular ring section 70*b* which is slidably and sealing received between the bore portion 42*a* and mandrel portion 54*d*. In the bore of the traveling nut 70 is a longitudinal spline groove or surface which cooperates with a longitudinal spline surface on the mandrel 54 so that the nut 70 is longitudinally but non-rotatively coupled to the mandrel 54. The external threads on the nut 70 are left hand threads and threadedly attach the nut 70 to the setting collar 34. The upwardly facing shoulder 54*g* between the surfaces 54*d* and 54*e* supports the nut 70 on the mandrel 54. The annulus between the mandrel 54 and setting collar 18 are pressure sealed by o-rings.

Above the mandrel portion 54*e* the mandrel portion 54*f* has an external threaded section 54*h* with right hand threads. The threaded section 54*h* is spaced by smooth diameter portion 54*f* from a downward facing shoulder 54*i*. A second tubular collar nut member 80 has an internal thread for threaded interconnection with the threaded section 54*h* on the mandrel 54. At the upper end of the nut member 80, the nut member has an internal o-ring seal to slidably and sealingly receive the diameter portion 54*f* of the mandrel 54. The threaded interconnection between the nut member 80 and mandrel 54 is a left hand thread. The nut member 80 at its lower outer end has outer downwardly extending spline fingers 80*b*. The spline fingers 80*b* interlock with spline grooves 80*c* in the bore section 42*d* to releasably interlock the nut member 80 to the setting collar 34.

In operation, the PBR 13 is previously located in the well bore. The setting tool 53 and retrievable assembly (collar 34 and sleeve 40) are lowered into the well bore on a tubing string until the setting collar 40 seats on the landing shoulder 17 of the PBR 13. A pressure sealing ball is dropped through the tubing string to seat on the seating flange 59 of the actuator sleeve 52 in the setting tool. The application of hydraulic pressure in the tubing string shifts the actuator sleeve 52 downwardly to apply force to the setting sleeve 40 and shear the interconnecting shear pin 51 between the setting sleeve 40 and setting collar 34 to move the setting sleeve 40 from an upper first position to a lower second position so that the latching lugs 19 are brought into latching engagement with the latching groove 20 in the PBR 13. The setting sleeve 40 is releasably locked in the second lower position by the one-way locking mechanism which includes the ring 53.

The setting tool is releasable from the setting collar 34 by right hand rotation which moves the traveling nut 70 upwardly and threadedly uncouples the traveling unit 70 from the setting collar 34. When the nut 70 is uncoupled from the setting collar 34, the tubing can retrieve the setting tool from the setting collar. The port 58 in the mandrel 55 bypasses fluid in the tubing string past the sealing ball on the flange 59.

To retrieve landing assembly, a tubing string with a spear is lowered into the upper end of the sleeve 40 and locks in the setting sleeve 40. Thereafter, a pull on the tubing string with sufficient force causes the breakable section 40*e* to part so that the setting sleeve 40 moves from a second lower position to a third upper position where a snap ring 48 locks the setting sleeve in the third position. With the latching lugs 19 released, setting sleeve and setting collar can be retrieved.

In the foregoing operation, with the landing assembly seated on the shoulder 17, the hydraulic setting need not be used or, in the event the hydraulic operation does not shift the actuator sleeve 52, then the operator can mechanically move the setting sleeve between the first upper position and the second lower position. The mechanical operation is accomplished by right-hand rotation which causes the setting collar 34 to unthread from the collar nut 80. The nut 80 is threaded to release with 5 turns or rotations while the nut 70 is threaded to release with 15 turns or rotations. Thus the nut 70 stays attached while the mandrel 54 is released from the collar nut 80 so that the mandrel 54 can be moved downwardly and the shoulder 52*b* on the mandrel 54 drives the actuator sleeve 52 downward and mechanically shifts the setting sleeve 40 from the first position to the second position. The threads 54 do not pass through the nut 70 as the downward stroke is sufficient to set the setting sleeve 40. In mechanically setting the setting sleeve 40, the setting sleeve 40 and setting collar 34 function as if they had been hydraulically set. The setting tool can then be rotated to release the nut 70 and the setting tool can be retrieved.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. A setting tool for use in a well bore with a well tool requiring a longitudinal motion for operation including, telescopically mounted upper and lower tubular members, said upper tubular member being adapted for coupling to a tubing string, said lower tubular member being longitudinally movable from a first upper position to a second lower position with respect to said upper tubular member, a first outer releasable interconnecting nut means for threadably interconnecting said upper tubular member to a well tool, said first releasable interconnecting nut means being slidably but non-rotatively mounted on said upper tubular member for permitting relative longitudinal motion between said upper tubular member and said first interconnecting nut means and for permitting co-rotation of said upper tubular member and said first nut means for releasing said first nut means from a well tool, a second outer releasable interconnecting nut means for threadably interconnecting said upper tubular member to a well tool, said second releasable interconnecting nut means being arranged for non-rotative releasable interconnection to a well tool for permitting upper tubular member to be releasable from interconnection with said second interconnecting nut means upon rotation of said upper tubular member relative to a well tool, said lower tubular member having an internal valve seat adapted for sealingly receiving a sealing means dropped through a tubing string so that hydraulic pressure can be applied for moving said lower tubular member between said first and second positions, said upper and lower tubular members being arranged so that said upper tubular member has a downwardly facing surface which is engagable with an upwardly facing surface on said lower member so that upon release from the threaded interconnection of said second interconnecting nut means, said upper tubular member can engage said lower member for longitudinally moving said lower tubular member conjunctively with said upper tubular member.

2. The apparatus as set forth in claim 1 wherein said lower tubular member and said upper tubular member are interconnected by a flange on one member which is slidably received in a recess in the other member.

3. The apparatus as set forth in claim 1 wherein first seal means are provided between said first nut means and said upper tubular member and between a well tool and said first nut means and second seal means are provided between said second nut means and said upper tubular member and where said second nut means is located above said first nut means.

4. The apparatus as set forth in claim 1 wherein first seal means are provided between said first nut means and said upper tubular member and between a well tool and said first nut means, and second seal means are provided between said second nut means and said upper tubular member and where said second nut means is located above said first nut means and wherein lower tubular member and said upper tubular member are interconnected by a flange on one member which is slidably received in a recess in the other member, and third seal means are provided between said flange and said recess.

5. A setting tool for use in a well bore with a well tool requiring a longitudinal motion for operation including, a tubular member, adapted for coupling to a tubing string, first outer releasable interconnecting nut means for threadably interconnecting said tubular member to a well tool, said first releasable interconnecting nut means being slidably but non-rotatively mounted on said tubular member for permitting relative longitudinal motion between said tubular member and said first interconnecting nut means and for permitting co-rotation of said tubular member and said first nut means for releasing said first nut means from a well tool, second outer releasable interconnecting nut means for threadably interconnecting said tubular member to a well tool, said second releasable interconnecting nut means being arranged for non-rotative releasable interconnection to a well tool for permitting said tubular member to be releasable from interconnection with said second interconnecting nut means upon rotation of said tubular member relative to a well tool, said tubular member being arranged so that tubular member has means providing a downwardly facing surface which is engagable with an upwardly facing surface on a well tool so that upon release of the threaded interconnection of said second interconnecting nut means relative to said tubular member, said tubular member can engage an upwardly facing surface on a well tool.

6. A setting tool and retrievable landing tool for use in a well bore system which has a downhole landing means and landing tool locking means located in position in a well bore; including:

a retrievable landing tool having telescopically mounted setting sleeve member and setting collar member where said setting collar member has landing means for engaging downhole landing means in a well bore system, said setting sleeve member having tool locking means movable between a non-locking position and a locking position in response to longitudinal movement of said setting sleeve member relative to said setting collar member between a first upper position and a second lower position when said landing means engages downhole landing means, a retrievable setting tool having telescopically mounted upper tubular setting mandrel and lower tubular actuator sleeve member where said actuator sleeve member is movable between a first upper position and a second lower position, means on said actuator sleeve member for mechanically engaging said setting sleeve member for conjunctively moving said actuator sleeve member and setting sleeve member longitudinally between said first positions and said second positions, said actuator sleeve member having means for selectively providing a sealed internal bore so that applied hydraulic pressure can move said actuator sleeve member between said first and second positions, first interconnecting nut means on said setting mandrel for threaded interconnection of said setting mandrel to a well tool, said first interconnecting nut means being releasable from a well tool by rotation but permitting relative longitudinal movement of said setting mandrel with respect to said first interconnecting nut means, and second interconnecting nut means on said setting mandrel for threadably interconnection of said second interconnecting nut means to said setting mandrel, said second nut means having a releasable spline coupling with a well tool to prevent relative rotation of said second nut means so that said setting mandrel is releasable from said second interconnecting nut means by relative rotation of said setting sleeve member for permitting conjunctive longitudinal movement of said setting mandrel and said actuator sleeve member.

7. The apparatus as set forth in claim 6 wherein said setting sleeve member is movable between a second lower position and a third position and means for locking said setting sleeve member in said third upper position.

8. A setting tool for use in a well bore with a well tool requiring a longitudinal motion for operation including, telescopically mounted upper and lower tubular members, said upper tubular member being adapted for coupling to a tubing string, said lower tubular member being longitudinally movable from a first upper position to a second lower position with respect to said upper tubular member, a first releasable interconnecting nut means for threadably interconnecting said upper tubular member to a well tool, said first releasable interconnecting nut means being slidably but non-rotatively mounted on said upper tubular member for permitting relative longitudinal motion between said upper tubular member and said first interconnecting nut means and for permitting co-rotation of said upper tubular member and said first nut means for releasing said first nut means from a well tool, a second releasable interconnecting nut means for threadably interconnecting said upper tubular member to a well tool, said second releasable interconnecting nut means being arranged for non-rotative and releasable connection to a well tool for permitting upper tubular member to be threadably releasable from connection with said second interconnecting nut means upon rotation of said upper tubular member relative to a well tool and releasable from connection with a well tool upon upward movement of said second nut means, said lower tubular member having means for selectively providing a sealed internal bore so that hydraulic pressure can be applied for moving said lower tubular member between said first and second positions, said upper and lower tubular members being arranged so that said upper tubular member has a downwardly facing surface which is engageable with an upwardly facing surface on said lower member so that upon release from the threaded connection of said second connecting nut means, said upper tubular member can engage said lower member for longitudinally moving said lower tubular member conjunctively with said upper tubular member.

9. A setting tool and retrievable landing tool for use in a well bore system which has a downhole landing means and landing tool locking means located in position in a well bore, including:

a retrievable landing tool having telescopically mounted setting sleeve member and setting collar member where said setting collar member has landing means for engaging downhole landing means in a well bore system, said setting sleeve member having tool locking means moveable between a non-locking position and a locking position in response to longitudinal movement of said setting sleeve member relative to said setting collar member between a first upper position and a second lower position when said landing means engages downhole landing means, a retrievable setting tool having telescopically mounted upper tubular setting mandrel and lower tubular actuator sleeve member where said actuator sleeve member is movable between a first upper position and a second lower position, means on said actuator sleeve member for mechanically engaging said setting sleeve member for conjunctively moving said actuator sleeve member and setting sleeve member longitudinally between said first positions and said second positions, said actuator sleeve member having means for selectively providing a sealed internal bore so that applied hydraulic pressure can move said actuator sleeve member between said first and second positions, first connecting nut means on said setting mandrel for threaded interconnection of said setting mandrel to a well tool, said first interconnecting nut means being releasable from a well tool by rotation but permitting relative longitudinal movement of said setting mandrel with respect to said first interconnecting nut means, and second connecting nut means on said setting mandrel for threaded interconnection of said second interconnecting nut means to said setting mandrel, said second nut means having a releasable coupling means cooperating with a well tool for preventing relative rotation of said second nut means so that said setting mandrel is releasable from said second interconnecting nut means by relative rotation of said setting sleeve member for permitting conjunctive longitudinal movement of said setting mandrel and said actuator sleeve member and so that said releasable coupling means is releasable from a well tool upon upward movement of said releasable coupling means relative to a well tool.

* * * * *

Notice of Adverse Decisions in Interference

In Interference No. 101,907, involving Patent No. 4,681,159, R. P. Allwin, M. Budke, SETTING TOOL FOR A WELL TOOL, final judgement adverse to the patentees was rendered May 24, 1990, as to claims 1-9.

[*Official Gazette October 23, 1990*]